US012599845B2

(12) United States Patent
Laiton

(10) Patent No.: US 12,599,845 B2
(45) Date of Patent: Apr. 14, 2026

(54) PIÑATA STRUCTURE AND METHOD FOR ASSEMBLING SAME

(71) Applicant: Amazing Pinata Inc., Los Angeles, CA (US)

(72) Inventor: Julian Fernando Aldana Laiton, Bogota (CO)

(73) Assignee: Amazing Pinatas Inc, Los Angeles, CA (US)

( * ) Notice: Subject to any disclaimer, the term of this patent is extended or adjusted under 35 U.S.C. 154(b) by 142 days.

(21) Appl. No.: 18/590,004

(22) Filed: Feb. 28, 2024

(65) Prior Publication Data

US 2024/0293758 A1 Sep. 5, 2024

Related U.S. Application Data

(60) Provisional application No. 63/449,209, filed on Mar. 1, 2023.

(51) Int. Cl.
*A63H 37/00* (2006.01)

(52) U.S. Cl.
CPC ..... *A63H 37/00* (2013.01)

(58) Field of Classification Search
CPC ..... A63H 37/00; A63H 33/00; A47F 5/02
USPC ..... 446/5, 71, 73, 108, 111, 112, 113, 115, 446/475, 487, 488
See application file for complete search history.

(56) References Cited

U.S. PATENT DOCUMENTS 3,702,675 A * 11/1972 Bajo ..... B65D 5/36 428/7
3,957,159 A * 5/1976 Radek ..... B60P 3/14 211/163
4,015,364 A * 4/1977 Oquita ..... A63H 37/00 446/5
4,082,356 A * 4/1978 Johnson ..... A47C 4/021 297/440.13
4,126,366 A * 11/1978 Handler ..... B25H 3/00 211/163

(Continued)

FOREIGN PATENT DOCUMENTS

WO WO-0216002 A1 * 2/2002 ..... A63H 37/00

*Primary Examiner* — Alexander R Niconovich
(74) *Attorney, Agent, or Firm* — Scheef & Stone, LLP; Mark D. Nielsen

(57) ABSTRACT

Systems and methods are disclosed that include providing a piñata with an improved piñata structure. The piñata structure includes a top, a bottom, and a center piece, each having a plurality of slots extending radially inward from a perimeter. A plurality of vertical column components engage the top, bottom, and centerpiece via complementary aligned upper, lower, and middle slots to form compartments in the piñata structure that can be filled with candy or confetti. A tube extending through the center of the piñata structure includes a string passing therethrough and coupled to an anchoring object at the bottom of the piñata structure. The string serves as an axis of rotation for the piñata structure. Tape, streamer, ribbon, or a combination thereof is wrapped around the piñata structure in consecutive layers and when peeled, the piñata rotates and expels the contents of the piñata structure.

18 Claims, 10 Drawing Sheets

(56) References Cited

U.S. PATENT DOCUMENTS 4,167,078 A * 9/1979 Oquita ..... A63H 37/00 446/5
4,253,266 A * 3/1981 Bajo ..... A63H 37/00 446/69
4,269,124 A * 5/1981 Rosenthal ..... A47F 5/02 108/103
4,787,872 A * 11/1988 Bajo ..... A63H 37/00 428/7
4,832,337 A * 5/1989 Estrada ..... A63F 9/0247 434/259
5,242,308 A * 9/1993 Estrada ..... A63H 37/00 446/5
5,263,889 A * 11/1993 Ledonne ..... A63H 33/00 446/75
5,536,194 A * 7/1996 Larsen ..... A63H 37/00 229/109
5,562,518 A * 10/1996 Estrada ..... A63H 37/00 220/8
5,824,378 A * 10/1998 Armendariz ..... B65D 81/368 428/7
6,171,166 B1 * 1/2001 Oquita ..... A63F 11/0011 446/73
6,206,493 B1 * 3/2001 Sanchez-Levin ..... A47F 5/05 312/249.2
6,354,904 B1 * 3/2002 Grey ..... A63H 37/00 446/5
6,648,713 B1 * 11/2003 Oquita ..... A63H 37/00 446/73
6,669,152 B2 * 12/2003 Hernandez ..... A63B 71/023 248/165
6,905,020 B2 * 6/2005 Chang ..... B25H 3/025 206/349
7,442,106 B1 * 10/2008 Menow ..... A63H 37/00 446/76
7,648,059 B2 * 1/2010 Pavlu, Jr. ..... A63H 37/00 229/116.1
7,878,341 B2 * 2/2011 Ming ..... B25H 3/025 211/164
8,112,918 B1 * 2/2012 Crowell ..... B43M 99/001 40/107
8,678,872 B1 * 3/2014 Valencia ..... A63H 33/00 446/5
9,586,157 B2 * 3/2017 Garcia ..... A63H 37/00
10,269,269 B2 * 4/2019 Bloome ..... G09F 1/14
11,140,979 B2 * 10/2021 Davidson ..... A47B 47/042
11,439,922 B2 * 9/2022 Monahan ..... A63H 37/00
11,990,062 B2 * 5/2024 Wertz ..... G09F 7/18
2003/0139276 A1 * 7/2003 Lozano ..... A63H 33/00 493/480
2007/0099534 A1 * 5/2007 Alas ..... A63H 37/00 446/5
2009/0325454 A1 * 12/2009 Cho ..... A63H 37/00 446/5
2010/0273389 A1 * 10/2010 Sui ..... A63H 37/00 446/5
2013/0337721 A1 * 12/2013 Guzman ..... A63H 37/00 446/5
2016/0129364 A1 * 5/2016 Arce Ardura ..... A63H 37/00 29/458
2017/0225091 A1 * 8/2017 Menow ..... A63H 37/00

* cited by examiner

PIÑATA STRUCTURE AND METHOD FOR ASSEMBLING SAME

CROSS-REFERENCE TO RELATED APPLICATIONS

This application claims the benefit of U.S. Provisional Patent Application No. 63/449,209 entitled "Improved Piñata Structure and Method for Assembling Same", filed on Mar. 1, 2023, which application including its Appendices are incorporated in its entirety by this reference.

TECHNICAL FIELD

The invention described herein generally relates to an improved structure for a piñata and method for assembling the same.

BACKGROUND OF THE INVENTION

In many cultures, piñatas are a traditional element for various festive occasions, including birthdays. Piñatas are often a shaped container made of cardboard, papier-mâché, clay, or cloth-like materials, which are typically decorated, filled with candy, confetti, fruit, or a combination thereof, and then broken as part of a celebration. The shape of the piñata can vary from geometric shapes to animal shapes, persons, or otherwise, and its final appearance is typically artistic and festive.

Another type of piñata is a spinning or rotating piñata in which ribbon, tape, or the like is used to wrap the piñata structure, and gradually pulled or tugged upon to simultaneously spin and unwrap the piñata. A spinning piñata is typically hung, and a rope, string, or similar element traversing the center of the piñata structure is used as an axis on which the piñata can be spun. As the piñata structure is spun, the ribbon or tape wrapping gradually falls away from the piñata and candy or other items fall from the internal portion of the piñata for receipt by onlookers.

SUMMARY

The present invention comprises a structure and method for making a spinning piñata. Its structure, however, may also be applied to a piñata wherein the present structure and method of assembly is used as the inner portion of a piñata and the outer portion of the piñata is shaped as an animal, geometric shape, or the like.

The present invention also comprises an improved construction for a rotating piñata in which the inner portion of the piñata is compartmentalized to provide for more even distribution of candy or the like, as well as more optimal weight distribution within the inner portion of the piñata and support for the bottom of the piñata so that the bottom of the piñata does not collapse from excess weight of its contents.

The present invention also comprises an improved piñata structure that does not require any adhesives, staples, or otherwise to hold its structure together, nor any more solid objects such as clay, and therefore, it is safe for use indoors as well as outdoors.

The present invention also comprises a method for straightforward and fun assembly process of the piñata described herein wherein the assembled piñata will be sturdy and hold sufficient capacity for a festive occasion.

The present invention may also further comprise an inner structure for a more traditional piñata (i.e., not a rotating piñata) wherein the decorative elements may be built around the present structure, but where the benefits of the piñata structure remain intact.

These and other features, aspects, and advantages of the present invention will become better understood with reference to the following description and appended claims.

BRIEF DESCRIPTION OF THE DRAWINGS

For a more complete understanding of the present disclosure and so that the manner in which the features and advantages of the embodiments can be understood in more detail, reference is now made to the following brief description, taken in connection with the accompanying drawings and detailed description.

The use of the same reference symbols in different drawings indicates similar or identical items.

DETAILED DESCRIPTION

The detailed description set forth below in connection with the appended figures is intended as a description of presently preferred embodiments of the invention and is not intended to represent the only forms in which the present invention may be constructed or utilized. The description sets forth the functions and the sequence of steps for constructing and/or operating the invention in connection with the illustrated embodiments. It is to be understood, however, that the same or equivalent functions and sequences may be accomplished by different embodiments that are also intended to be encompassed within the spirit and scope of the invention.

Figure 1:
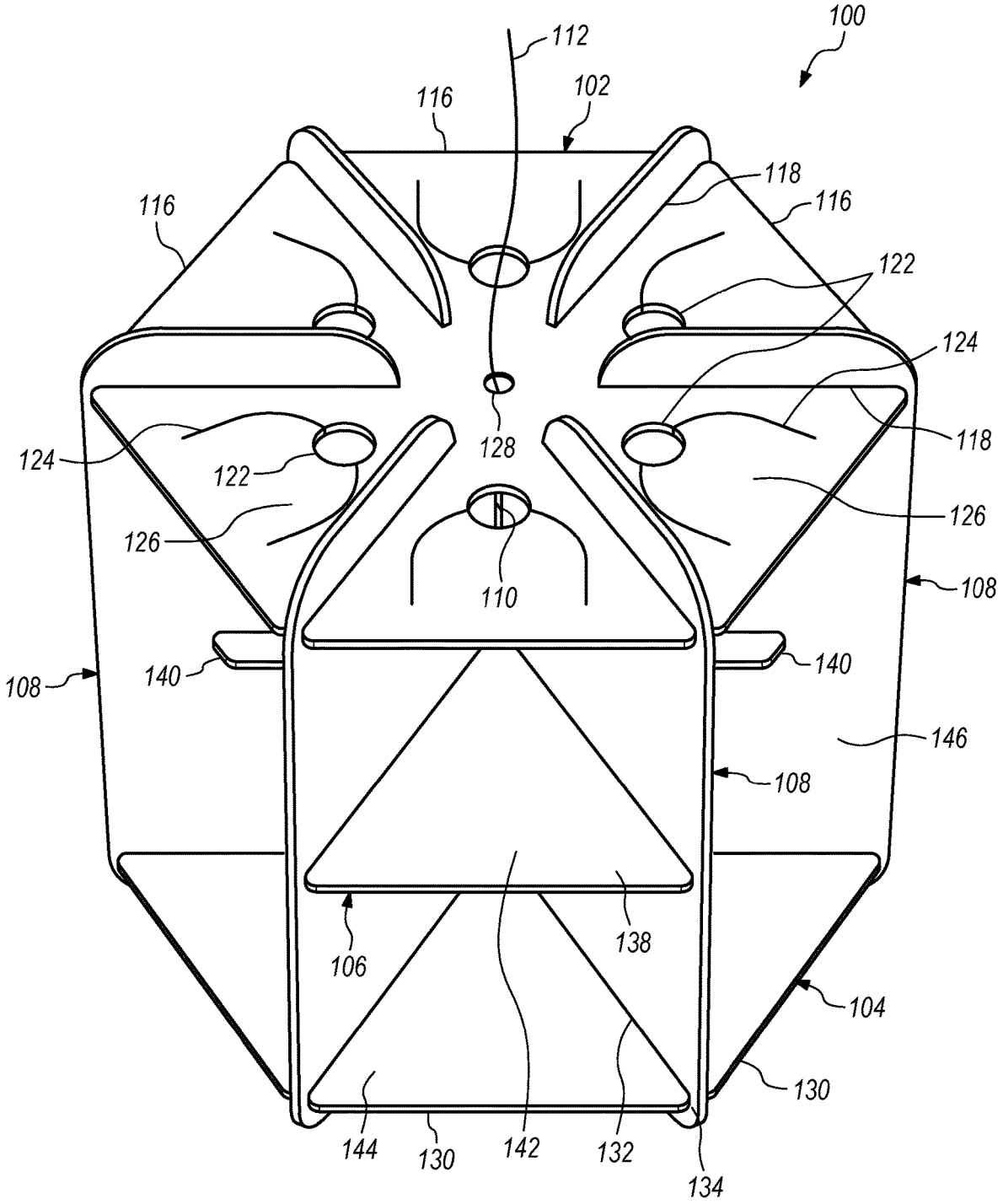
FIG. 1 shows a top perspective view of a piñata structure according to an embodiment of the disclosure.
Figure 2:
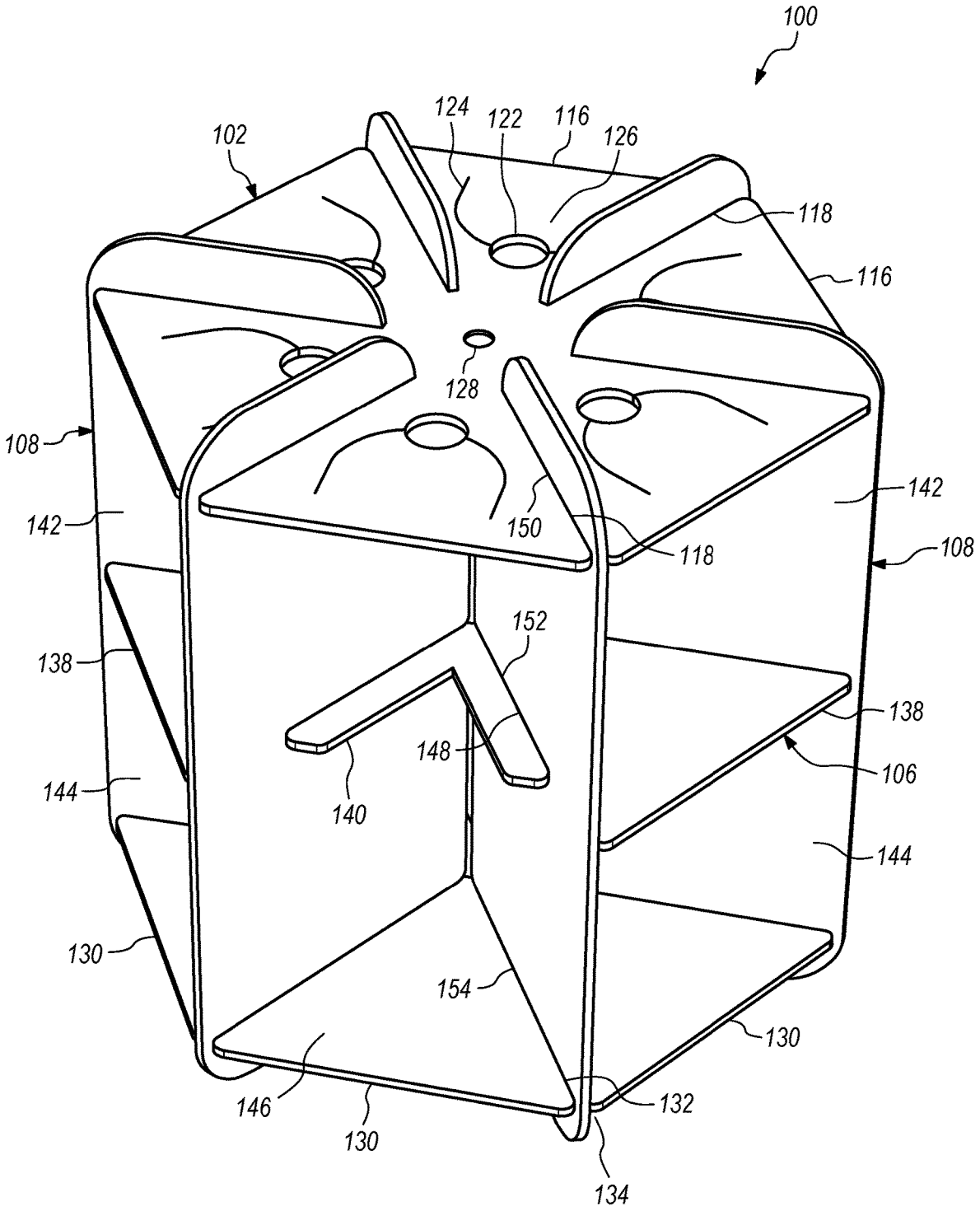
FIG. 2 shows another top perspective view of the piñata structure according to an embodiment of the disclosure.
Figure 3:
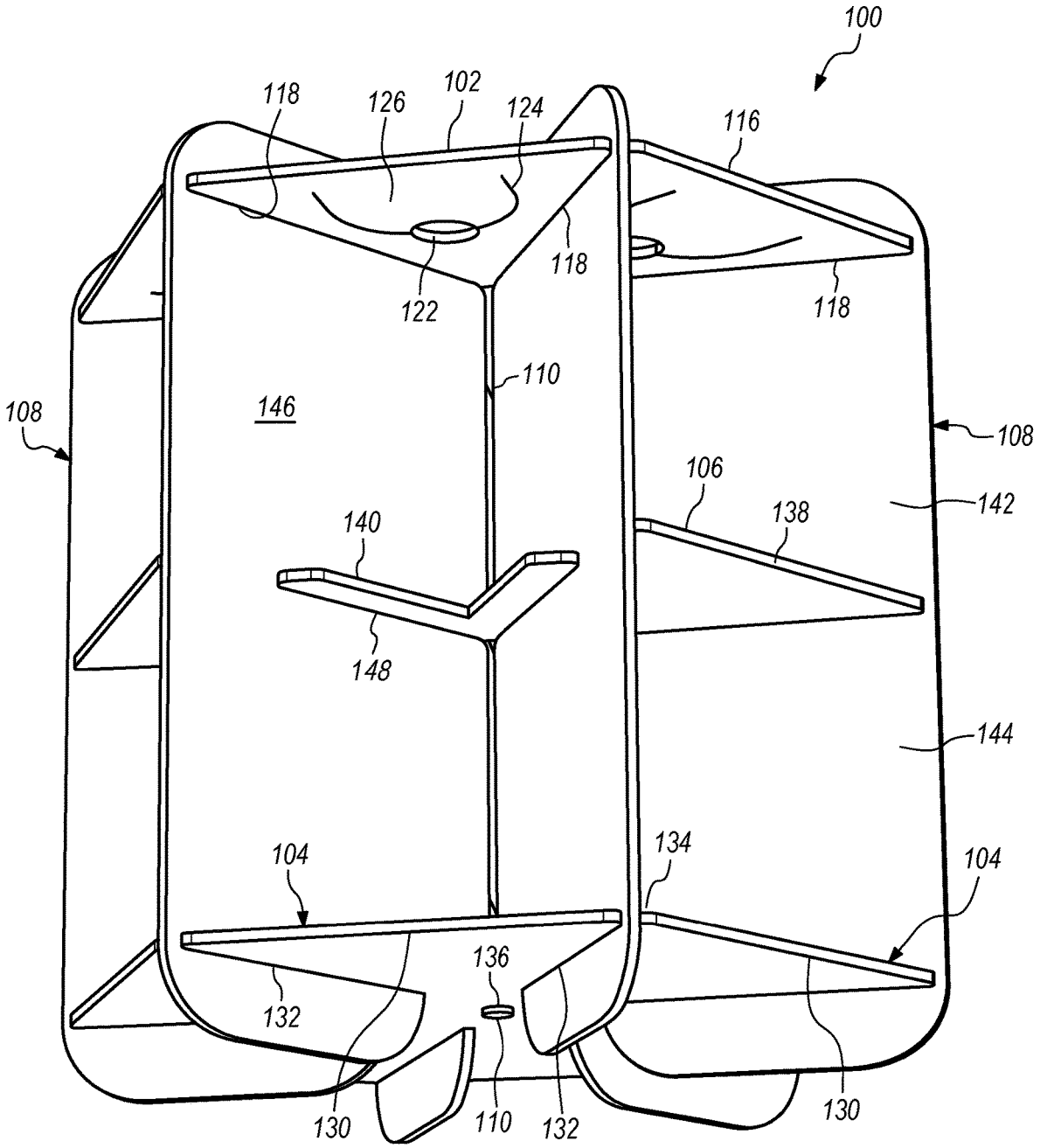
FIG. 3 shows a bottom perspective view of the piñata structure according to an embodiment of the disclosure.
Figure 4:
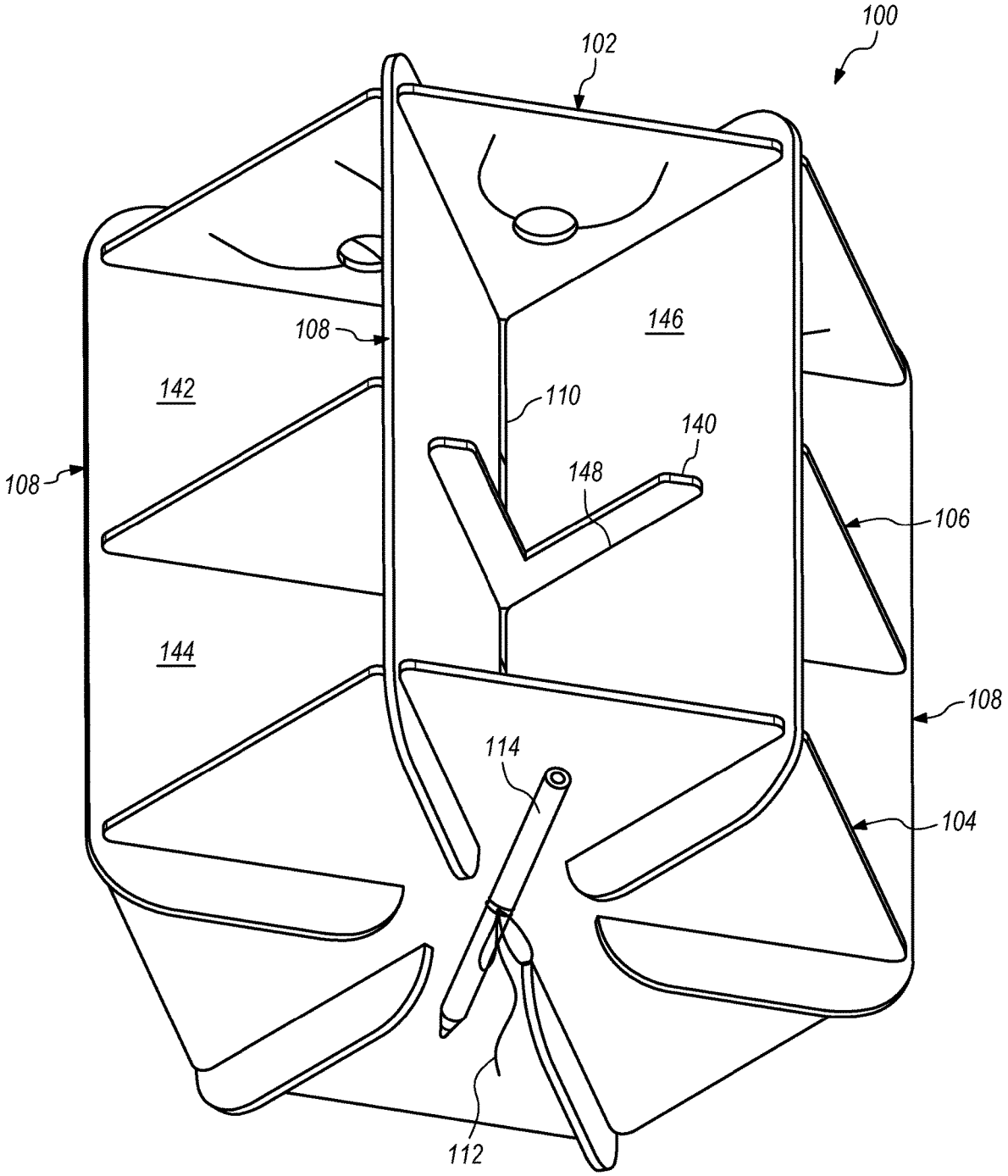
FIG. 4 shows another bottom perspective view of the piñata structure according to an embodiment of the disclosure.
Figure 5:
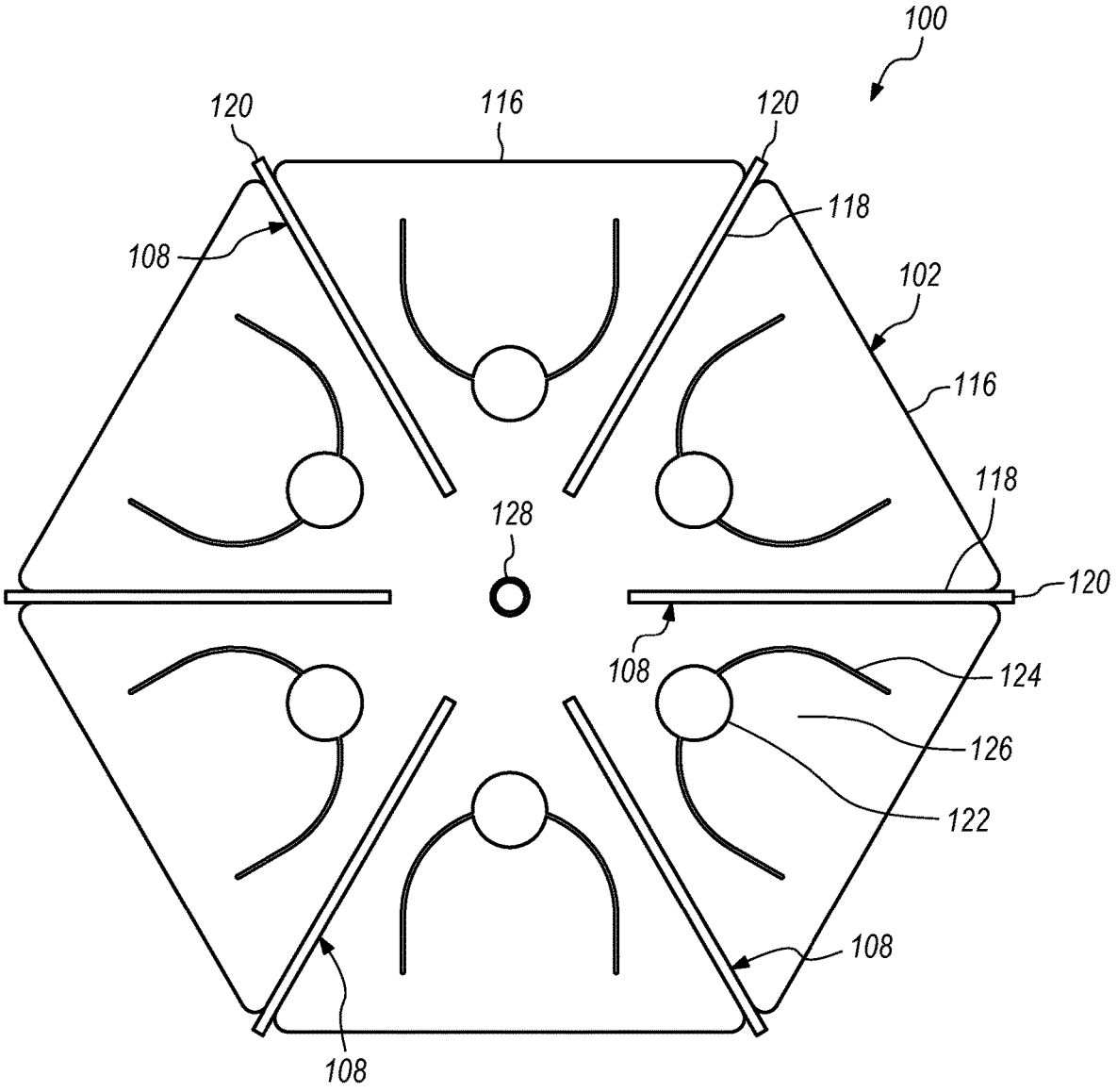
FIG. 5 shows an orthogonal top view of the piñata structure according to an embodiment of the disclosure.
Figure 6:
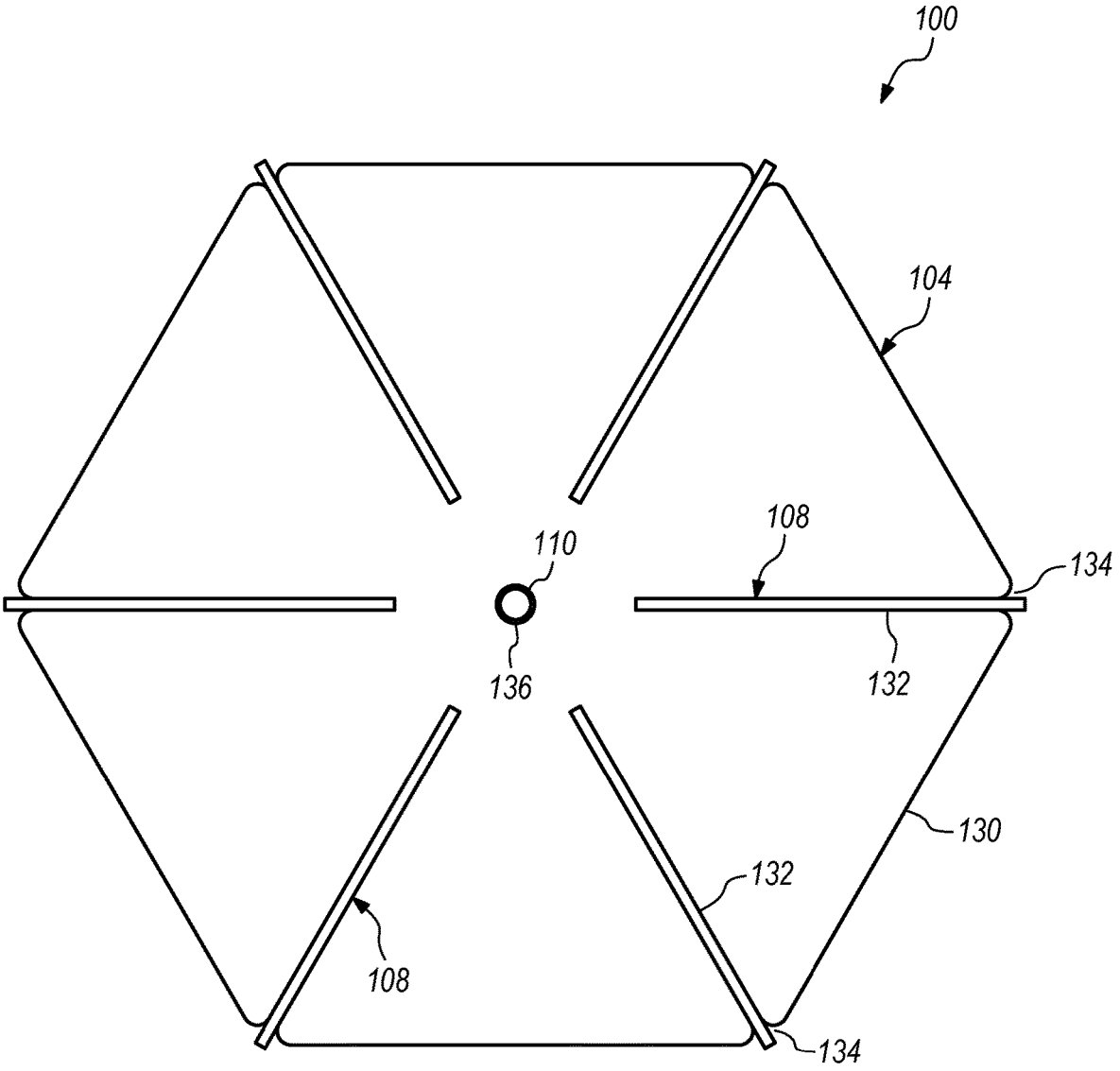
FIG. 6 shows an orthogonal bottom view of the piñata structure according to an embodiment of the disclosure.
Figure 7:
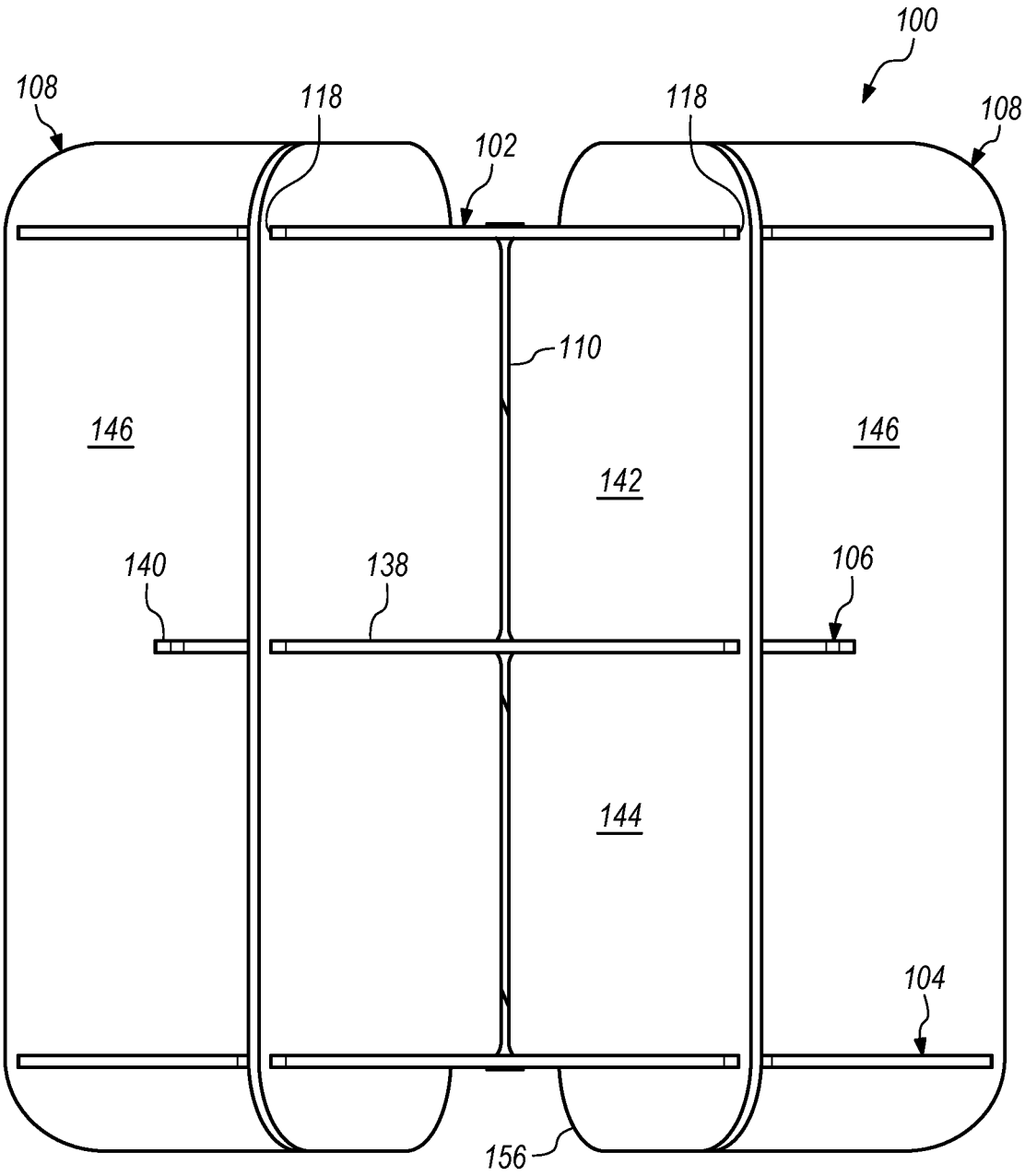
FIG. 7 shows an orthogonal side view of the piñata structure according to an embodiment of the disclosure.
Figure 8:
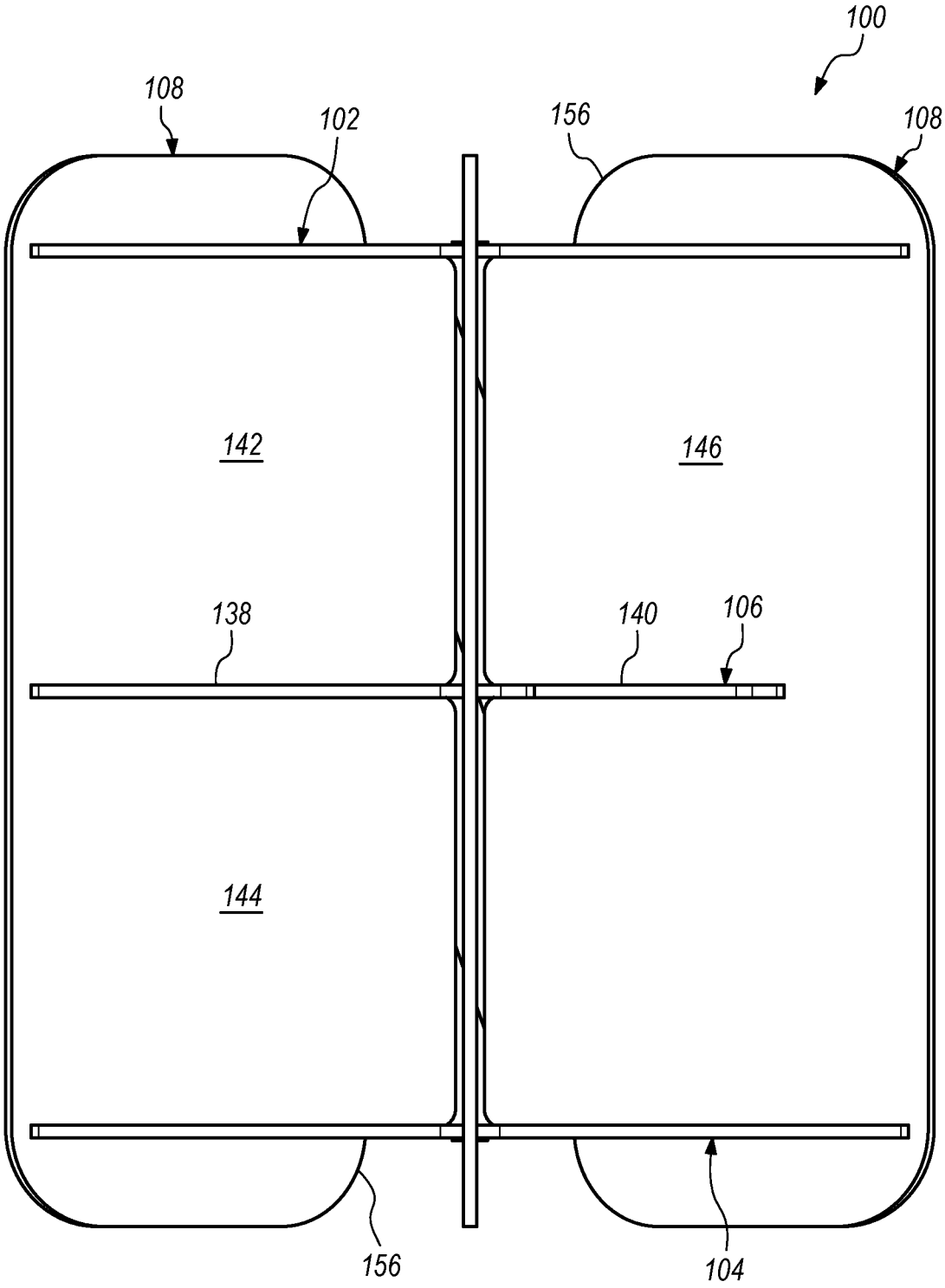
FIG. 8 shows another orthogonal side view of the piñata structure according to an embodiment of the disclosure.
Figure 9:
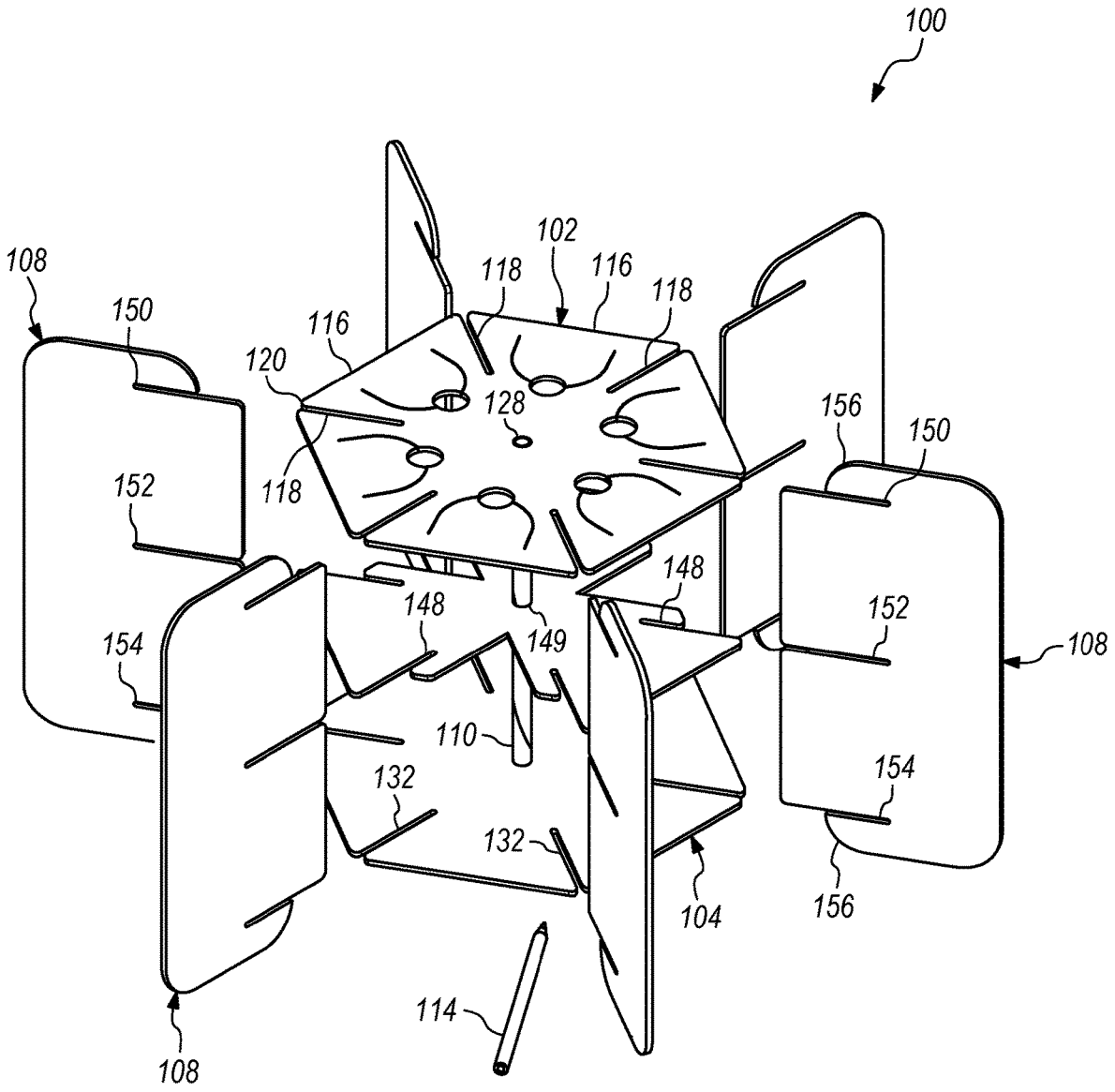
FIG. 9 shows an exploded perspective view of the piñata structure according to an embodiment of the disclosure.
Figure 10:
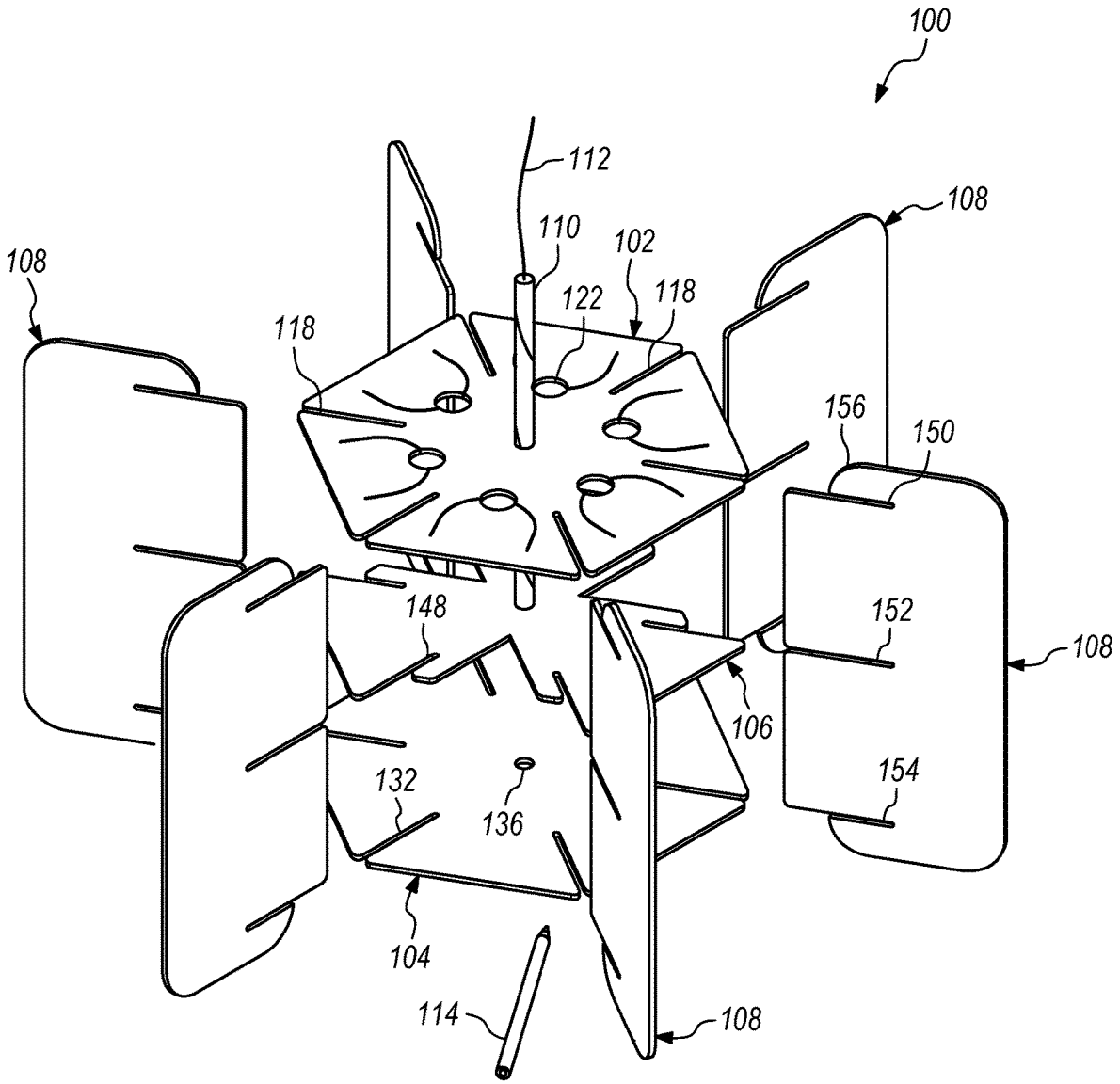
FIG. 10 shows another exploded perspective view of the piñata structure according to an embodiment of the disclosure.

Referring to FIGS. 1 to 10, various views of a piñata structure 100 are shown according to an embodiment of the disclosure. The piñata structure 100 described herein may generally comprise a top 102, a base or bottom 104, a center piece 106, and a plurality of vertical column pieces 108. In some embodiments, the piñata structure 100 may also comprise a center tube 110, a string 112 disposed therethrough, and a pencil or other anchoring object 114 used to secure the string 112 to the piñata structure 100.

The top 102 may generally comprise a hexagonal shape comprising six equal sides 116. However, in other embodiments, the top 102 may comprise any number of sides (e.g., 3, 4, 5, etc.) depending on the preferred configuration or shape of the piñata structure 100. The top 102 may comprises a plurality of slots 118 equally spaced around the top 102 and cutting radially inward from corners 120 formed between adjacent sides 116 around the perimeter of the top 102. In some embodiments, the corners 120 may be beveled, chamfered, or rounded to enhance or promote easy assembly of the piñata structure 100. As will be discussed later herein, the top 102 may also comprise a plurality of access holes 122 that each intersect a score line 124 that defines an access flap or compartment cover 126 for each of the compartments of the piñata structure 100. The top 102 may also comprise a central opening 128. The central opening 128 may function to receive the center tube 110 therethrough, which may be formed from cardboard, plastic, or another suitable sturdy material.

The bottom 104 may also comprise a hexagonal shape comprising six equal sides 130. In some embodiments, the bottom 104 may be substantially similar in size to the top 102. As such, it will be appreciated that the bottom 104 may comprise the same number of sides 130 as the top 102. The bottom 104 may also comprise a plurality of slots 132 equally spaced around the bottom 104 and cutting radially inward from corners 134 formed between the sides 130 around the perimeter of the bottom 104. In some embodiments, the corners 134 may be beveled, chamfered, or rounded to enhance or promote easy assembly of the piñata structure 100. The bottom 104 may also comprise a central opening 136. In some embodiments, the central opening 136 may also function to receive the center tube 110 therethrough. However, in some embodiments, the central opening 136 may be smaller than a diameter of the center tube 110, such that the center tube 110 rests on a top surface of the bottom 104.

The center piece 106 may comprise three horizontal dividers 138 that are alternatingly disposed between support structures 140. In some embodiments, the dividers 138 may be vertically aligned with the sides 116 of the top 102 and/or the sides 130 of the bottom 104 to form an upper compartment 142 between the top 102 and the center piece 106 and a lower compartment 144 between the bottom 104 and the centerpiece 106. The support structures 140 may represent removed portions of the centerpiece 106 that form a larger, single compartment 146 that extends between the top 102 and the bottom 104. The center piece 106 may also comprise a plurality of slots 148 equally spaced around the center piece 106 and cutting radially inward from the support structures 140. It will be appreciated that the slots 148 may be shorter than the slots 118, 132 formed in each of the top 102 and the bottom 104, respectively. Additionally, the center piece 106 may also comprise a central opening 149. Similar to central openings 128, 136, the central opening 149 may also function to receive the center tube 110 therethrough.

The vertical column pieces 108 may generally be configured to engage with the top 102, the bottom 104, and the center piece 106 to form the compartments 142, 144, 146 about the piñata structure 100. More specifically, the vertical column pieces 108 may comprise horizontal slots 150, 152, 154 integrally formed therein. Each of the vertical column pieces 108 may comprise a upper slot 150, a middle slot 152, and a lower slot 154 that cut radially outwards from an inner edge of the vertical column pieces 108. The slots 150, 152, 154 may be formed to be substantially perpendicular to the center tube 110 and the axis of rotation of the piñata structure 100.

The vertical column pieces 108 may comprise a height greater than the height of the compartments, which allows the vertical column pieces 108 to extend above the top 102 and below the bottom 104 of the piñata structure 100, with each vertical column's protrusion forming an upper septum and a lower septum. In some embodiments, the upper slots 150 and the lower slots 154 may be shorter than the middle slots 152 because the structure of the vertical column pieces 108 includes cutaway portions 156 disposed at the inner top and the inner bottom of each of the vertical column pieces 108. In some embodiments, the cutaway portions 156 may be beveled, chamfered, or rounded. Accordingly, the upper slot 150 may be configured to engage one of the slots 118 in the top 102, the middle slot 152 may be configured to engage one of the slots 148 in the center piece 106, and the lower slot 154 may be configured to engage one of the slots 132 in the bottom 104. In this manner, the piñata structure 100 may be assembled and structurally sound.

The center tube 110 may generally be disposed through the central openings 128, 136, 149 in each of the top 102, bottom 104, and center piece 106. In some embodiments, the center tube 110 may be formed from cardboard, plastic, or another suitable sturdy material. In some embodiments, the center tube 110 may comprise a constant diameter. However, in some embodiments, the center tube 110 may taper from one end to the other. The center tube 110 facilitates passing the string 112 therethrough from a top to a bottom of the piñata structure 100. In some embodiments, the string 112 may comprise a string, a rope, or other similar, sturdy elongated object. The string 112 may be coupled to or tied to the pencil or other anchoring object 114 at the bottom of the piñata structure 100. In some embodiments, the pencil or other anchoring object 114 may rest against the bottom 104 and support the weight of the piñata structure 100. The string 112 may function as an axis of rotation for the piñata structure 100

In some embodiments, the piñata structure 100 preferably comprises nine compartments 142, 144, 146, comprising three upper compartments 142, three lower compartments 144, and three larger compartments 1146 that extend between the top 102 and the bottom 104. Vertically, the piñata structure 100 preferably comprises six vertical column spaces. In three alternating (i.e., non-adjacent from left to right) column spaces, the column spaces are vertically divided by the horizontal dividers 138 that extend radially outwards from the center piece 106. In the other three column spaces, there is no horizontal divider 138, and the vertical columns fill the height of the piñata structure 100. In other words, the three upper compartments 142 and the three lower compartments 144 are above and below each other, respectively, effectively dividing three alternating column spaces of the piñata structure into the three upper compartments 142 and the three lower compartments 144. The other three column spaces span substantially the entire height of piñata structure 100, between the top 102 and the bottom 104 of the piñata structure 100.

Each upper compartment 142 and larger compartment 146 of the piñata structure 100 comprises an access hole 122 and a score line 124 that defines an access flap or compartment cover 126 for each of the compartments 142, 146 of the piñata structure 100. The access holes 122 comprise a hole in the cardboard structure that allows a user's finger or other suitable object (such as a pen, pencil, or screwdriver) to be inserted, so that the access flap or compartment cover 126 of each compartment 142, 146 of the piñata structure 100 may be opened to allow materials such as candy or confetti to be inserted into each compartment 142, 146 by a user. The score lines 124 may define or provide a perimeter along which the access flaps or compartment covers 126 may be folded and opened.

The three upper compartments 142 are designed to facilitate improved distribution of the contents of the piñata structure 100. In spinning or rotating piñatas, it is common for most of the contents to accumulate at the bottom so that when the piñata is spun, and the ribbon or other wrapping gradually falls off from the top to the bottom of the piñata, the contents are only expelled in the last few spins. Embodiments of the piñata structure 100 described herein allows the contents to be expelled more evenly during the spinning process, without the need for excessive filling with contents.

The three lower compartments 144 are not fillable as there is no access to them (following assembly) to fill them up with contents such as candy or otherwise. The emptiness of the three lower compartments 144, however, serves to control or regulate the carrying capacity of the piñata structure 100 and prevents it from being overfilled and possibly breaking or falling before use or completion of use. The three larger compartments 146 comprises larger vertical spaces than the three upper compartments 142, and thus, possesses approximately double the capacity of the upper compartments 142, thereby increasing the storage capacity of the piñata structure 100.

To assemble the piñata structure 100, the top 102, the bottom 104, and the center piece 106 may be assembled with a first vertical column piece 108. In no particular order, the upper slot 150 of the vertical column piece 108 may be inserted into one of the slots 118 in the top 102, the middle slot 152 of the vertical column piece 108 may be inserted into one of the slots 148 in the center piece 106, and the lower slot 154 of the vertical column piece 108 may be inserted into one of the slots 132 in the bottom 104. Preferably, assembly of the piñata structure 100 entails assembling opposing vertical column pieces 108. In other words, the first and second vertical column pieces 108 should essentially be aligned radially and essentially bisect the shape of the piñata structure 100 when viewed from the top. This process may continue with the remaining vertical column pieces 108 until all slots 150, 152, 154 of vertical column pieces 108 have been inserted radially into the slots 118, 132, 148, respectively, such that the upper slots 150 of the vertical column pieces 108 engage one of the slots 118 in the top 102, the middle slots 152 of the vertical column pieces 108 engage one of the slots 148 in the center piece 106, and the lower slots 154 of the vertical column pieces 108 engage one of the slots 132 in the bottom 104.

Once the overall piñata structure 100 is assembled, the center tube 110 may be inserted into the central opening 128 of the top 102, passed through the central opening 149 of the center piece 106, and rest on the central opening 136 of the bottom 104, which is preferably smaller in diameter so as to form a ledge or seat for the center tube 110. Once the center tube 110 is in place, the string 112 may be passed through the center tube 110 and out of the bottom end of center tube 110 with sufficient length remaining on both ends to permit the piñata structure 100 to be suspended from the ceiling or other fixed structure by the string 112, and to permit a knot to be securely tied to the pencil or other anchoring object 114. Once the piñata is suspended or hung, the pencil or other anchoring object 114 contacts an underside of the bottom 104 to support the weight of the piñata structure 100.

The piñata structure 100 may be wrapped by affixing adhesive material, such as double-sided tape to the bottom 104 inside one or more of the compartments 142, 144, 146 at a location in the compartment 142, 144, 146 that is distal from the center tube 110 or central axis of the piñata (e.g., substantially flush with an outer edge of one or more of the vertical column pieces 108). A first end of a stretch of decorative tape, streamer, or ribbon may be affixed to the double-sided adhesive and wrapped circumferentially and/or horizontally around the piñata structure 100, while maintaining tension on the tape, streamer, or ribbon. The tape, streamer, or ribbon may be wrapped around the piñata structure 100 in consecutive layers, such that substantially no vertical space is left between the progressive layers as they layer vertically up the side of the piñata structure 100. This process is continued until the entire side portion of the piñata is wrapped with the tape, streamer, or ribbon.

A portion of the tape, streamer, or ribbon adjacent a second end (the end opposite the first end) of the tape, streamers, or ribbon is affixed to a second area of adhesive material located near the top 102 or inside one of the compartments 142, 144, 146 at a location that is distal from the center tube 110 or the central axis of the piñata (e.g., substantially flush with an outer edge of one or more of the vertical column pieces 108). In this manner, a portion of excess tape or ribbon is available to tug or pull upon when the piñata is placed into use.

In use, the fully assembled piñata comprising the piñata structure 100 may be suspended from a hook in a ceiling or other similar sixed structure. The tape, streamer, or ribbon that is used to enclose the piñata and which is affixed to adhesive elements is then pulled repeatedly to cause the tape, streamer, or ribbon to slowly and progressively reveal from top to bottom the compartments 142, 144, 146 containing candy or the like in the piñata structure 100 with the centrifugal force of the spinning structure, thereby causing the candy or the like to be expelled from the structure once the tape, streamers, or ribbon no longer prevents such expulsion.

It will be appreciated that a piñata structure 100 may include one or more of the following embodiments:

Embodiment 1. A piñata structure, comprising: a top comprising a plurality of sides and having a plurality of slots equally spaced about the top and extending radially inward from a perimeter of the top; a bottom comprising a plurality of sides and having a plurality of slots equally spaced about the bottom and extending radially inward from a perimeter of the bottom; a center piece comprising a plurality of slots, wherein the plurality of slots in the center piece are aligned vertically with the plurality of slots in each of the top and the bottom; a plurality of vertical column components, each of the plurality of vertical column components comprising an upper slot configured to engage with one of the plurality of slots in the top, a lower slot configured to engage with one of the plurality of slots in the bottom, and a middle slot configured to engage with one of the plurality of slots in the center piece; a tube that extends through a central opening in the top and the center piece; and a string disposed through the tube and coupled to an anchoring object at a bottom of the piñata structure, wherein the string is configured to function as an axis of rotation for the piñata structure.

Embodiment 2. The piñata structure of embodiment 1, wherein the top and the bottom are a substantially similar size.

Embodiment 3. The piñata structure of embodiment 1, wherein the top and the bottom comprise a same number of sides.

Embodiment 4. The piñata structure of embodiment 1, wherein the top and the bottom comprise at least three sides.

Embodiment 5. The piñata structure of embodiment 1, wherein the top and the bottom comprise a hexagonal shape comprising six equal sides.

Embodiment 6. The piñata structure of embodiment 1, wherein the plurality of slots formed in each of the top and the bottom extend radially inward from a perimeter of each of the top and bottom.

Embodiment 7. The piñata structure of embodiment 6, wherein the plurality of slots formed in each of the top and the bottom extend radially inward from corners formed between adjacent sides of each of the top and the bottom.

Embodiment 8. The piñata structure of embodiment 7, wherein the corners are beveled, chamfered, or rounded to promote easy assembly of the piñata structure.

Embodiment 9. The piñata structure of embodiment 1, wherein the center piece comprises a plurality of horizontal dividers that are alternatingly disposed between support structures and that divide column spaces formed between adjacent vertical column pieces into an upper compartment and a lower compartment.

Embodiment 10. The piñata structure of embodiment 9, wherein the plurality of slots formed in the center piece extend radially inward from the support structures.

Embodiment 11. The piñata structure of embodiment 10, wherein the plurality of slots formed in the center piece are shorter than the plurality of slots formed in each of the top and the bottom.

Embodiment 12. The piñata structure of embodiment 1, wherein each of the plurality vertical column pieces extend above the top and below the bottom.

Embodiment 13. The piñata structure of embodiment 1, wherein the upper slot, the lower slot, and the middle slot formed in the vertical column pieces extend radially outwards from an inner edge of each of the plurality of vertical column pieces.

Embodiment 14. The piñata structure of embodiment 13, wherein each of the plurality of vertical column pieces comprise cutaway portions disposed at an inner top portion and an inner bottom portion, and wherein the cutaway portions are beveled, chamfered, or rounded.

Embodiment 15. The piñata structure of embodiment 14, wherein the middle slot is longer than the upper slot and the lower slot.

Embodiment 16. The piñata structure of embodiment 1, wherein the piñata structure comprises a plurality of compartments.

Embodiment 17. The piñata structure of embodiment 16, wherein the piñata structure comprises nine compartments.

Embodiment 18. The piñata structure of embodiment 1, wherein the piñata structure comprises a plurality of upper compartments formed between the top and a horizontal divider of the center piece and between adjacent vertical column pieces, a plurality of lower compartments formed between the bottom and a horizontal divider of the center piece and between adjacent vertical column pieces, and a plurality of larger compartments formed between the top and the bottom and between adjacent vertical column pieces.

Embodiment 19. The piñata structure of embodiment 18, wherein each lower compartment is disposed below an upper compartment, and wherein each adjacent lower compartment and upper compartment is disposed between adjacent larger compartments.

Embodiment 20. The piñata structure of embodiment 19, wherein the top comprises a plurality of access flaps, and wherein each access flap provides access to an upper compartment or a larger compartment to allow candy or confetti to be inserted into each of the upper compartments and the larger compartments.

Embodiment 21. The piñata structure of embodiment 20, wherein the upper compartments are configured to facilitate improved distribution of contents of the piñata structure when the piñata structure is rotated about the string.

Embodiment 22. The piñata structure of embodiment 1, wherein the piñata structure is formed from cardboard, plastic, or a combination thereof.

Embodiment 23. The piñata structure of embodiment 1, further comprising: tape, streamer, ribbon, or a combination thereof wrapped around the piñata structure in consecutive layers.

Embodiment 24. A method of assembling a piñata structure, comprising: providing a top, a bottom, a center piece, a plurality of vertical column pieces, a tube, and a string; inserting an upper slot of each of the plurality of the vertical column pieces into one of a plurality of slots formed in the top; inserting a middle slot of each of the plurality of vertical column pieces into one of a plurality of slots formed in the center piece; inserting a lower slot of each of the vertical column pieces into one of a plurality of slots formed in the bottom; inserting a tube into a central opening of the top and the center piece; inserting a string through the tube; and affixing an anchoring object to the string at a bottom of the piñata structure.

Embodiment 25. The method of embodiment 24, further comprising: wrapping tape, streamer, ribbon, or a combination thereof around the piñata structure in consecutive layers to form a piñata.

Embodiment 26. The method of embodiment 25, further comprising: accessing one or more of a plurality of compartments formed in the piñata structure through one or more of a plurality of access flaps formed in the top; and inserting candy or confetti into one or more of the accessed compartments.

In the foregoing specification, the concepts have been described with reference to specific embodiments. However, those of ordinary skill in the art appreciate that various modifications and changes can be made without departing from the scope of the invention as set forth in the claims below. Other examples that occur to those skilled in the art are intended to be within the scope of the claims if they have structural elements that do not differ from the literal language of the claims, or if they include equivalent structural elements with insubstantial differences from the literal languages of the claims. Accordingly, the specification and figures are to be regarded in an illustrative rather than in a restrictive sense, and all such modifications are intended to be included within the scope of the invention.

Benefits, other advantages, and solutions to problems have been described above with respect to one or more specific embodiments. After reading the specification, those of ordinary skill in the art will appreciate that certain features that are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range and include sub-ranges that overlap from one preferred range to another preferred range.

What is claimed is:

1. A spinning piñata structure, comprising:

a top comprising a plurality of sides and having a plurality of slots equally spaced about the top and extending radially inward from a perimeter of the top;

a bottom comprising a plurality of sides and having a plurality of slots equally spaced about the bottom and extending radially inward from a perimeter of the bottom;

a center piece comprising a plurality of slots, wherein the plurality of slots in the center piece are aligned vertically with the plurality of slots in each of the top and the bottom;

a plurality of vertical column components, each of the plurality of vertical column components comprising an upper slot configured to engage with one of the plurality of slots in the top, a lower slot configured to engage with one of the plurality of slots in the bottom, and a middle slot configured to engage with one of the plurality of slots in the center piece;

a tube that extends through a central opening in the top and the center piece;

a string disposed through the tube and coupled to an anchoring object at a bottom of the piñata structure, wherein the string is configured to function as an axis of rotation for the piñata structure; and wrapping tape, streamers, ribbons, or a combination thereof around the piñata structure in consecutive layers to enclose the piñata structure.

2. The spinning piñata structure of claim 1, wherein the top and the bottom are a substantially similar size.

3. The spinning piñata structure of claim 1, wherein the top and the bottom comprise at least three sides.

4. The spinning piñata structure of claim 3, wherein the top and the bottom comprise a hexagonal shape comprising six equal sides.

5. The spinning piñata structure of claim 1, wherein the plurality of slots formed in each of the top and the bottom extend radially inward from corners formed between adjacent sides of each of the top and the bottom.

6. The spinning piñata structure of claim 5, wherein the corners are beveled, chamfered, or rounded to promote easy assembly of the piñata structure.

7. The spinning piñata structure of claim 1, wherein the center piece comprises a plurality of horizontal dividers that are alternatingly disposed between support structures and that divide column spaces formed between adjacent vertical column components into an upper compartment and a lower compartment.

8. The spinning piñata structure of claim 7, wherein the plurality of slots formed in the center piece extend radially inward from the support structures.

9. The spinning piñata structure of claim 1, wherein each of the plurality vertical column components extend above the top and below the bottom.

10. The spinning piñata structure of claim 1, wherein the upper slot, the lower slot, and the middle slot formed in the vertical column components extend radially outwards from an inner edge of each of the plurality of vertical column components.

11. The spinning piñata structure of claim 10, wherein each of the plurality of vertical column components comprise cutaway portions disposed at an inner top portion and an inner bottom portion, and wherein the cutaway portions are beveled, chamfered, or rounded.

12. The spinning piñata structure of claim 1, wherein the spinning piñata structure comprises at least nine compartments.

13. The spinning piñata structure of claim 1, wherein the spinning piñata structure comprises a plurality of upper compartments formed between the top and a horizontal divider of the center piece and between adjacent vertical column components, a plurality of lower compartments formed between the bottom and a horizontal divider of the center piece and between adjacent vertical column components, and a plurality of larger compartments formed between the top and the bottom and between adjacent vertical column components.

14. The spinning piñata structure of claim 13, wherein each lower compartment is disposed below an upper compartment, and wherein each adjacent lower compartment and upper compartment is disposed between adjacent larger compartments.

15. The spinning piñata structure of claim 14, wherein the top comprises a plurality of access flaps, and wherein each access flap provides access to an upper compartment or a larger compartment to allow candy or confetti to be inserted into each of the upper compartments and the larger compartments.

16. The spinning piñata structure of claim 1, wherein the spinning piñata structure is formed from cardboard, plastic, or a combination thereof.

17. A method of assembling a spinning piñata structure, comprising:

providing a top, a bottom, a center piece, a plurality of vertical column pieces, a tube, and a string;

inserting an upper slot of each of the plurality of the vertical column pieces into one of a plurality of slots formed in the top, each of the slots extending radially inward from a perimeter of the top;

inserting a middle slot of each of the plurality of vertical column pieces into one of a plurality of slots formed in the center piece, each the slots extending radially inward from a perimeter of the center piece;

inserting a lower slot of each of the vertical column pieces into one of a plurality of slots formed in the bottom, each the slots extending radially inward from a perimeter of the bottom;

inserting a tube into a central opening of the top and the center piece;

inserting a string through the tube to function as an axis of rotation for the piñata structure affixing an anchoring object to the string at a bottom of the spinning piñata structure; and wrapping tape, streamers, ribbons, or a combination thereof around the spinning pinata structure.

18. The method of claim 17, further comprising: accessing one or more of a plurality of compartments formed in the spinning piñata structure through one or more of a plurality of access flaps formed in the top; and inserting candy or confetti into one or more of the accessed compartments.

* * * * *